US005738496A

United States Patent [19]

Mehta

[11] Patent Number: 5,738,496

[45] Date of Patent: Apr. 14, 1998

[54] INTERCHANGEABLE PLUG-IN CIRCUIT COMPLETION MODULES FOR VARYING THE ELECTRICAL CIRCUITRY OF A CEILING FAN

[75] Inventor: Vinay Mehta, Germantown, Tenn.

[73] Assignee: Hunter Fan Company, Memphis, Tenn.

[21] Appl. No.: 773,488

[22] Filed: Dec. 23, 1996

[51] Int. Cl.[6] ..... G04B 49/06

[52] U.S. Cl. ..... 417/44.1; 417/572; 340/825.72; 416/5

[58] Field of Search ..... 417/572, 44.1, 417/42, 44.11; 416/5, 170 R; 361/695; 307/141; 340/825.71, 825.72, 825.22

[56] References Cited

U.S. PATENT DOCUMENTS

| | | | |
|---|---|---|---|
| 4,322,632 | 3/1982 | Hart et al. | 307/41 |
| 4,371,814 | 2/1983 | Hannas | 318/16 |
| 4,413,211 | 11/1983 | Fowler | 318/257 |
| 4,494,055 | 1/1985 | Bitting et al. | 318/254 |
| 4,500,821 | 2/1985 | Bitting et al. | 318/254 |
| 4,546,554 | 10/1985 | Angott | 417/572 |
| 4,621,992 | 11/1986 | Angott | 417/572 |
| 4,686,380 | 8/1987 | Angott | 307/125 |
| 4,716,409 | 12/1987 | Hart et al. | 340/825.22 |
| 4,719,446 | 1/1988 | Hart | 340/310 |
| 4,721,480 | 1/1988 | Yung | 439/527 |
| 4,818,920 | 4/1989 | Jacob | 318/16 |
| 4,935,736 | 6/1990 | Meierdierck | 340/825.69 |
| 4,990,908 | 2/1991 | Tung | 340/825.63 |
| 5,029,271 | 7/1991 | Meierdierck | 329/347 |
| 5,033,113 | 7/1991 | Wang | 455/603 |
| 5,041,825 | 8/1991 | Hart et al. | 340/825.06 |
| 5,164,644 | 11/1992 | Hsieh | 318/284 |
| 5,187,472 | 2/1993 | Hart et al. | 340/825.69 |
| 5,189,412 | 2/1993 | Mehta et al. | 340/825.22 |
| 5,340,277 | 8/1994 | Whitaker | 416/5 |
| 5,458,311 | 10/1995 | Holbrook | 248/309.1 |
| 5,463,286 | 10/1995 | D'Aleo et al. | 315/295 |
| 5,488,273 | 1/1996 | Chang | 318/16 |
| 5,528,229 | 6/1996 | Mehta | 340/825.06 |
| 5,541,584 | 7/1996 | Mehta et al. | 340/825.57 |
| 5,559,406 | 9/1996 | Chang | 340/825.22 |

*Primary Examiner*—Timothy Thorpe
*Assistant Examiner*—Xuan M. Thai
*Attorney, Agent, or Firm*—Baker, Donelson, Bearman & Caldwell

[57] ABSTRACT

A ceiling fan having interchangeable plug-in circuit completion modules for varying the electrical driver circuitry of the fan. Each module is selectively designed to complete a motor driving circuit and/or a light driving circuit and are preferably installed in the switch housing of the fan. In addition, the modules contain selectively designed circuitry to enable a user to either manually or remotely control the fan. Since the modules are interchangeable, the driver control circuitry of the fan may be easily converted between manual and remote control.

13 Claims, 10 Drawing Sheets

INTERCHANGEABLE PLUG-IN CIRCUIT COMPLETION MODULES FOR VARYING THE ELECTRICAL CIRCUITRY OF A CEILING FAN

BACKGROUND

The present invention relates generally to the field of controls for ceiling fans, and more specifically, to an add-on remote control circuit completion module adapted for plugging into existing ceiling fan circuitry to convert a standard non-remote controlled ceiling fan into a full-function remote controlled ceiling fan.

Modern ceiling fans typically may be operated over a wide range of speeds ranging from a relatively low speed to a high maximum speed. Low speeds may be desirable to provide general air circulation and to eliminate "hot" or "cold" spots within a room. Higher speeds may be desirable to provide cooling effects (in summer) or to eliminate temperature gradients (in winter). In addition, the direction of rotation of most modern ceiling fans may be reversed. In the winter, it is generally desirable to have the fan turn in one direction to circulate hot air away from the ceiling. In the summer, it may be desirable to have the fan turn in the opposite direction to provide a cooling effect on the occupants in the room by circulating cool air toward the floor. Moreover, modern ceiling fans are often combined with a separate light fixture. The intensity level of the light may be controlled from low levels to maximum high levels. While a modern ceiling fan may be installed almost anywhere power is available, most are designed to be readily installed at existing ceiling junction boxes, replacing an existing light fixture. By installing a ceiling fan at an existing ceiling junction box, the existing wiring in the home is used without the need to install additional electrical wiring to operate the fan.

A standard non-remote controlled ceiling fan typically includes a fan motor, a switch housing and a light fixture. The switch housing normally contains the necessary switches, a capacitor for the auxiliary winding and electrical components for manually operating and controlling the speed and direction of the fan motor. Since the switch housing typically serves as a central location for most of the electrical circuitry, generally all of the electrical connections of the ceiling fan are made in the switch housing. In most instances, a pull-chain switch is used to manually select between different motor speeds, as well as to turn the fan motor on or off. Depending on the design of the fan motor, double-pole double-throw (DPDT) or single-pole double-throw (SPDT) slide switches are typically utilized to reverse the direction of the motor. Standard light fixtures typically include a separate pull-chain switch to turn the light on and off.

Almost all of the electrical circuitry in a standard non-remote controlled ceiling fan is located and connected in the switch housing in a relatively permanent arrangement such as by "hard wiring." Additional electrical elements in the switch housing ordinarily include a capacitor for the motor and a set of speed control capacitors in series with the fan motor to drop the voltage at the motor windings. The capacitors generally have different values to offer different impedance to the motor. By connecting the speed control capacitors in series with the motor between the speed control switch and fan motor, the supply voltage to the motor can be raised or lowered to change the speed of the motor.

Capacitors are the most commonly used form of external impedance to control motor speed because they generate relatively little heat as compared to other types of external impedance such as resistors and inductors. One problem, however, with using capacitors as an impedance method is their relatively large size in relation to other electrical components. Capacitors tend to occupy large amounts of valuable space within the switch housing and therefore usually dominate the design (e.g., arrangement) of electrical circuitry. Simply enlarging the size of the switch housing to accommodate different circuit designs which include speed control capacitors may not only be aesthetically displeasing to the highly diverse personal preferences and tastes of individual consumers, but may also create structural design problems in the ceiling fan such as limiting the available locations for attaching the fan blades, especially if the ceiling fan design requires the blades to be mounted to the bottom of an "inside-out" fan motor. Therefore, most ceiling fan manufacturers try to minimize the size of the switch housing to avoid the above problems and to reduce cost.

The problems associated with fan mounted switches in existing standard non-remote controlled ceiling fans has fostered a new impetus in the ceiling fan industry toward development of an "add-on" remote control module for converting a non-remote controlled ceiling fan to a remote controlled ceiling fan which is user friendly and cost efficient. However, known add-on modules suffer from many drawbacks. For instance, since all of the electrical connections between the various electrical components (e.g., motor, light, switches, capacitors) are relatively permanently interconnected in the switch housing, a problem arises as to where and how to connect an add-on module to an existing ceiling fan.

Even though the most logical location for an add-on remote control module is in the switch housing, electrically interconnecting a module in the switch housing with the various electrical components, in most instances, requires the services of someone trained in the art of electronics such as a licensed electrician. In fact, such installation would not be considered "adding-on" a remote control module, rather a total rewiring of the ceiling fan which is not practical and too costly. This is one reason why most ceiling fan manufacturers have designed their add-on remote control modules to be connected to the ceiling fan outside of the switch housing such as in the canopy.

Known add-on modules are commonly installed by connecting the module across the main lines of the ceiling fan in series with the fan motor and light fixture. Although this eliminates the need to disturb or rewire any of the circuitry in the switch housing, the output control signals from the module must by-pass certain originally installed electrical components, such as the speed control capacitors, in order to perform the function of remotely controlling the ceiling fan. The circuitry in a typical add-on module is basically limited to a speed control portion for the motor and a light dimmer portion for the light. The speed control portion typically includes several general purpose relays or triacs to switch between the various speeds of the motor. However, in order for the relays or triacs to perform their intended function, the speed control portion of the module must also include its own set of speed control capacitors in series with the relays or triacs and the originally installed speed control switch in the switch housing must always be set at "high" to by-pass the original speed control capacitors. This specific electrical configuration is necessary in known add-on modules because in order for the relays or triacs to utilize the originally installed speed control capacitors in the switch housing, the original capacitors would have to be directly wired to the relays or triacs which defeats the intended purpose of the "add-on" module. More importantly, however, having to incorporate speed control capacitors into the module to control motor speed not only increases its cost but also increases its size thereby making installation in the switch housing virtually impossible.

In addition to being too large to fit in the switch housing of a standard non-remote controlled ceiling fan, known add-on remote control modules are unable to remotely reverse the direction of the fan motor. The remote control functions are partial in that they are limited only to speed and light control. The direction of the motor can be reversed only by utilizing the manual reversing slide switch. To remotely reverse the direction of the motor, the motor windings must be directly wired to the module which defeats the intended purpose of a user friendly "add-on" module.

Since the canopy assembly of some standard ceiling fans generally supports the entire fan, an individual who wishes to install a typical add-on remote control module in the canopy of such a fan is forced to remove and support the weight of the ceiling fan while performing the work. Therefore, installation may be tedious and dangerous and may require the assistance of an additional person(s). Moreover, even though the module is connected across the main lines, the complexities of house wiring are beyond the capabilities of most "do-it-yourselvers". Installing a module may expose such individuals to an electrical shock due to their close proximity to the power source. Alternatively, the individual may have to incur the additional expense of hiring a licensed electrician. Assuming the module is correctly installed, if the module (or transmitter) becomes inoperable for any reason, the ceiling fan cannot be operated manually or remotely until the module is removed, which requires reconnecting the main lines of the ceiling fan back to the A.C. power supply, or until the module (or transmitter) is replaced or repaired. Either case will involve the above described difficulties and expense.

In view of the foregoing disadvantages associated with known add-on remote control modules, a need exists for an interchangeable plug-in circuit completion module which is readily connected to and disconnected from existing ceiling fan driver control circuitry to enable a person unskilled in electrical wiring to easily and selectively convert the control of a ceiling fan between manual control and full-function remote control. Also, there is a need for an interchangeable plug-in circuit completion module that utilizes the impedance in the existing driver control circuitry to control the speed of the fan motor. An even further need exists for an interchangeable plug-in circuit completion module which enables a user to remotely reverse the direction of the fan motor. Finally, a need exists for interchangeable plug-in circuit completion modules that are capable of plugging directly into the circuitry in the switch housing.

SUMMARY

The present invention addresses the above needs as well as others by providing a ceiling fan which utilizes an interchangeable plug-in circuit completion module to vary the electrical circuitry of the fan so that a user may control the fan either manually or remotely. The ceiling fan further includes a switch housing and, if desired, a conventional light fixture having at least one location for operatively receiving a light.

The present invention utilizes driver control circuitry to control the operation of the fan. A portion of the driver control circuitry is installed in the fan in a relatively permanently interconnected fashion (i.e., prewired). Even though the prewired portion of the driver circuitry includes electrical wiring and components for controlling the operation of the fan motor and light, it generally does not include all of the wiring and/or electrical components necessary to complete a total driver circuit such as a motor driving circuit or light driving circuit. The prewired portion, however, may contain one or more auxiliary circuits to perform ancillary functions.

In order to complete at least one primary driver control circuit, a driver circuit completion module containing the wiring and/or electrical components necessary to complete the circuit(s) is electrically interconnected with the prewired driver circuitry by any suitable connector means such as readily connectable and disconnectable connectors. Thus, the circuit completion module constitutes part of the overall driver control circuitry of the ceiling fan and is designed for ready interconnection with and disconnection from the prewired driver circuitry. Furthermore, by selectively designing the circuitry (e.g., wiring and/or components) in the circuit completion module, one can create (i.e., complete) an unlimited number or combinations of driver control circuits for controlling the fan either manually or remotely.

In a preferred embodiment of the present invention, the prewired driver circuitry and circuit completion module are installed in the switch housing. The prewired driver circuitry may include any suitable speed control switching means for manually controlling the speed of the fan motor, any suitable reverse switching means for manually reversing the direction of the motor, any suitable light switching means for manually controlling the illumination or intensity of the light, any suitable motor impedance means for selectively lowering the supply voltage to the motor windings, and a phase capacitor for operating the motor. The connector means preferably consists of a multiple pin male end connector and a corresponding multiple pin female end connector. Both connectors are designed for mating cooperation with one another and other similar connectors. The male end connector is electrically interconnected with (i.e., constitutes part of) the prewired driver circuitry while the female end connector is electrically interconnected with (i.e., part of) the circuitry in the circuit completion module. Completion of a motor driving circuit and/or a light driving circuit is accomplished by simply plugging the male end connector of the prewired driver circuitry into the female end connector of the circuit completion module.

The circuit completion module may be selectively designed as either a manual control circuit completion module or a remote control circuit completion module which enables a user the ability to control the operation of the fan either manually or remotely. Providing the user the choice between both types of circuit completion modules (e.g., manual and remote) will enable the user to easily vary the driver control circuitry of the fan allowing the control of the fan to be easily converted between manual and remote control. If a user desires to manually operate the ceiling fan by the switching means in the switch housing, the user simply has to plug the manual control module into the prewired driver circuitry. In order to convert a manually operated ceiling fan into a remotely controlled ceiling fan, the user has to simply unplug the manual control module from the prewired driver circuitry and plug the remote control module in its place (i.e., into the prewired driver circuitry). Since the manual control module may be directly wired to or contain an electrical component such as a speed control switch, it preferably remains in the switch housing once disconnected from the prewired driver circuitry. A manual control circuit completion module according to the present invention typically includes the female end connector of the connector means and necessary wiring for electrically communicating with the existing prewired driver circuitry. The manual control module may, however, further include the speed control switching means for manually controlling the speed of the motor.

Depending on the circuitry contained in the remote control module, a user may remotely control the motor on/off, speed and direction functions as well as the light on/off and intensity functions. The remote control module includes a modularized housing selectively designed to fit in most ceiling fan switch housings. The circuitry contained in the housing typically includes a speed control switching device for enabling a user to remotely select between different fan motor speeds, a reverse switching device for enabling a user to remotely reverse the direction of the motor, a light dimmer device for enabling a user to remotely control the intensity of the light, a receiver unit for controlling the above devices in response to communication signals received from a remote transmitter unit, and the female connector portion of the connector means. The receiver unit may assume any conventional configuration. The transmitter unit may be hand held or permanently mounted in a wall in which case it is wired directly to the ceiling fan. Unlike ceiling fans which employ the use of known add-on remote control modules, if the remote control module or transmitter unit of the present invention become inoperable for any reason, the user may simply convert the ceiling fan back to a manually controlled ceiling fan by simply unplugging the remote control module and plugging the manual control module back in its place (i.e., back into the prewired driver circuitry).

Unlike known add-on remote control modules, the speed control switching device in the remote control module utilizes the originally installed motor impedance means to remotely control the speed of the fan motor. Thus, there is no need to provide a separate motor impedance such as a set of speed control capacitors in the remote control module. By employing the use of the already existing motor impedance means in the prewired driver circuitry, the remote control module enjoys several advantages over the known add-on remote control modules. For instance, capacitors are the most commonly used form of impedance to control motor speed, however, they tend to occupy a significant amount of space in a standard switch housing. Since most known add-on modules include their own speed control capacitors, they typically cannot be physically installed in a standard switch housing because of their generally large size. In direct contrast, by selectively designing the remote control module to utilize the existing motor impedance means, the remote control module of the present invention will be small enough to readily fit in the switch housing. Moreover, by not requiring a duplicate motor impedance means, the remote control module may be less expensive than existing add-on modules.

BRIEF DESCRIPTION OF THE DRAWINGS

These and other features, aspects, and advantages of the present invention will become better understood with regard to the following detailed description, appended claims, and accompanying drawings wherein:

DESCRIPTION

Figure 1:
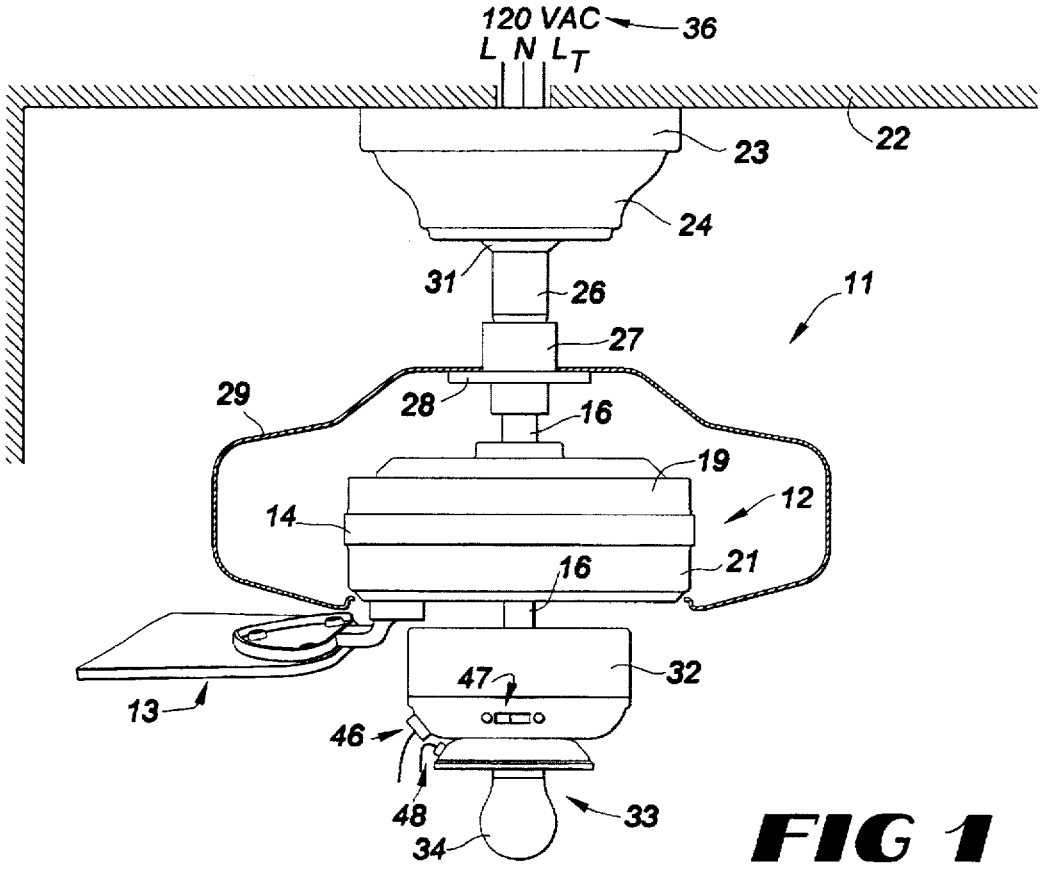
FIG. 1 illustrates a ceiling fan, partially in cross-section, embodying features of the present invention.

Referring now in more detail to the drawings, FIG. 1 illustrates a ceiling fan 11 which embodies the features of the present invention. The fan 11 employs a motor 12 to drive a plurality of fan blades 13 (only one shown) which provide an additional degree of air circulation within a room. The motor 12 may be an "inside-out" permanent split phase induction motor having typically 14 to 20 poles wherein the number of poles determine, among other electrical and structural characteristics, the desired range of motor speeds and the diameter of motor 12. A rotor 14 surrounds a stator assembly (not shown). The stator assembly is mounted on a non-rotating central hollow shaft 16 having externally threaded upper and lower ends. The core of the stator assembly is typically constructed from a stack of ferromagnetic laminations having radially extending slots in register with one another which extend longitudinally through the laminations. Preferably, a plurality of separate concentrically wound coils (one coil for each pole of the motor) are electrically interconnected and inserted into the slots of the stator assembly to form a main winding 17 and auxiliary winding 18 (shown in FIGS. 9–12) of motor 12. The motor 12 may also include top 19 and bottom 21 end covers which are attached by any suitable means to rotor 14. End covers 19 and 21 rotate with rotor 14 about the stator assembly and central hollow shaft 16 during operation. Depending on the particular design of fan 11, blades 13 may be attached by any suitable means to either the top 19 or bottom 21 end covers.

In order to suspend the fan 11 from ceiling 22, fan 11 may include a mounting plate 23 which is rigidly attached to an existing ceiling junction box in ceiling 22, a canopy 24, a hollow tubular downrod 26 having an externally threaded lower end, an internally threaded hollow boss 27 having a flange 28, and a motor housing 29 for substantially enclosing motor 12. The upper end of downrod 26 is attached to a ball member 31 which is secured within canopy 24. The ball member 31 allows pivotal movement of downrod 26. The internally threaded boss 27 is secured directly to the externally threaded lower end of downrod 26. The externally threaded upper end of shaft 16 is secured to boss 27 thereby suspending motor 12 from ceiling 22. Flange 28 on boss 27 serves to support motor housing 29.

Fan 11 further includes a switch housing 32 and, if desired, a conventional light fixture 33 having at least one location for operatively receiving a light 34. In a preferred embodiment, switch housing 32 is secured directly to the externally threaded lower end of central hollow shaft 16. Fan 11 draws power from an A.C. supply voltage 36 through load line (L), light load line ($L_T$) and neutral line (N). Unless specifically referenced hereinafter, lines L, $L_T$ and N are collectively shown as line 37 in FIGS. 2–4 and are referred to as "terminal lines 37".

Figure 2:
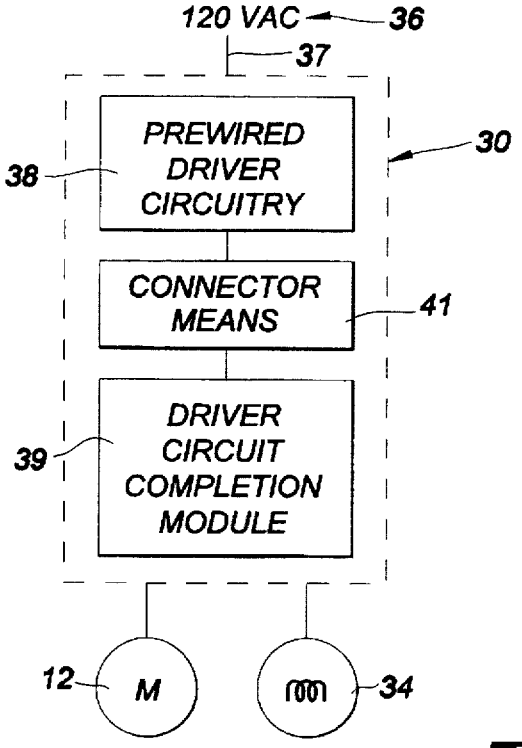
FIG. 2 is a simplified schematic representation, partially in block diagram form, of a driver control circuit embodying features of the present invention.

FIG. 2 is a simplified schematic representation, partially in block diagram form, of a driver control circuit 30 configuration (shown in dashed lines) of fan 11 for controlling the operation of motor 12 and/or light 34. As illustrated, a portion 38 of the driver control circuitry 30 is prewired in fan 11. The term "prewired" as it applies to prewired portion 38 generally denotes being installed in fan 11 in a relatively permanently interconnected fashion by any suitable wiring means such as by "hard-wiring" or printed wiring circuit board. Even though the prewired portion 38 of the driver circuitry 30 includes electrical wiring and components for controlling the operation of motor 12 and light 34, the prewired portion 38 generally does not include all of the wiring and/or electrical components necessary to complete a total primary driver circuit. However, the prewired portion 38 may include sufficient circuitry to form one or more auxiliary circuits to perform ancillary functions. In order to complete at least one primary driver control circuit 30, such as a motor driving circuit and/or a light driving circuit, a driver circuit completion module 39 containing the wiring and/or electrical components necessary to complete the circuit(s) is electrically interconnected with the prewired driver circuitry 38 by any suitable connector means 41, such as readily connectable and disconnectable connectors. Thus, circuit completion module 39 constitutes part of the driver control circuitry 30 of fan 11 and is designed for ready interconnection with and disconnection from the prewired driver circuitry 38. By selectively designing the circuitry (e.g., wiring and/or components) in the circuit completion module 39, one can create (i.e., complete) an unlimited number driver control circuits 30 for controlling fan 11 either manually or remotely.

Connector means 41 enables a person who is untrained or unskilled in the art of electrical wiring to easily connect and disconnect the circuit completion module 39 from the prewired driver circuitry 38. By selectively designing connector means 41, the circuit completion module 39 may be positioned in any suitable location in fan 11, such as in canopy 24, motor housing 29, switch housing 32 or alternatively in the immediate vicinity of fan 11, so long as module 39 is electrically connected to the prewired driver circuitry 38. Thus, circuit completion module 39 need not be physically mounted in fan 11.

Figure 3:
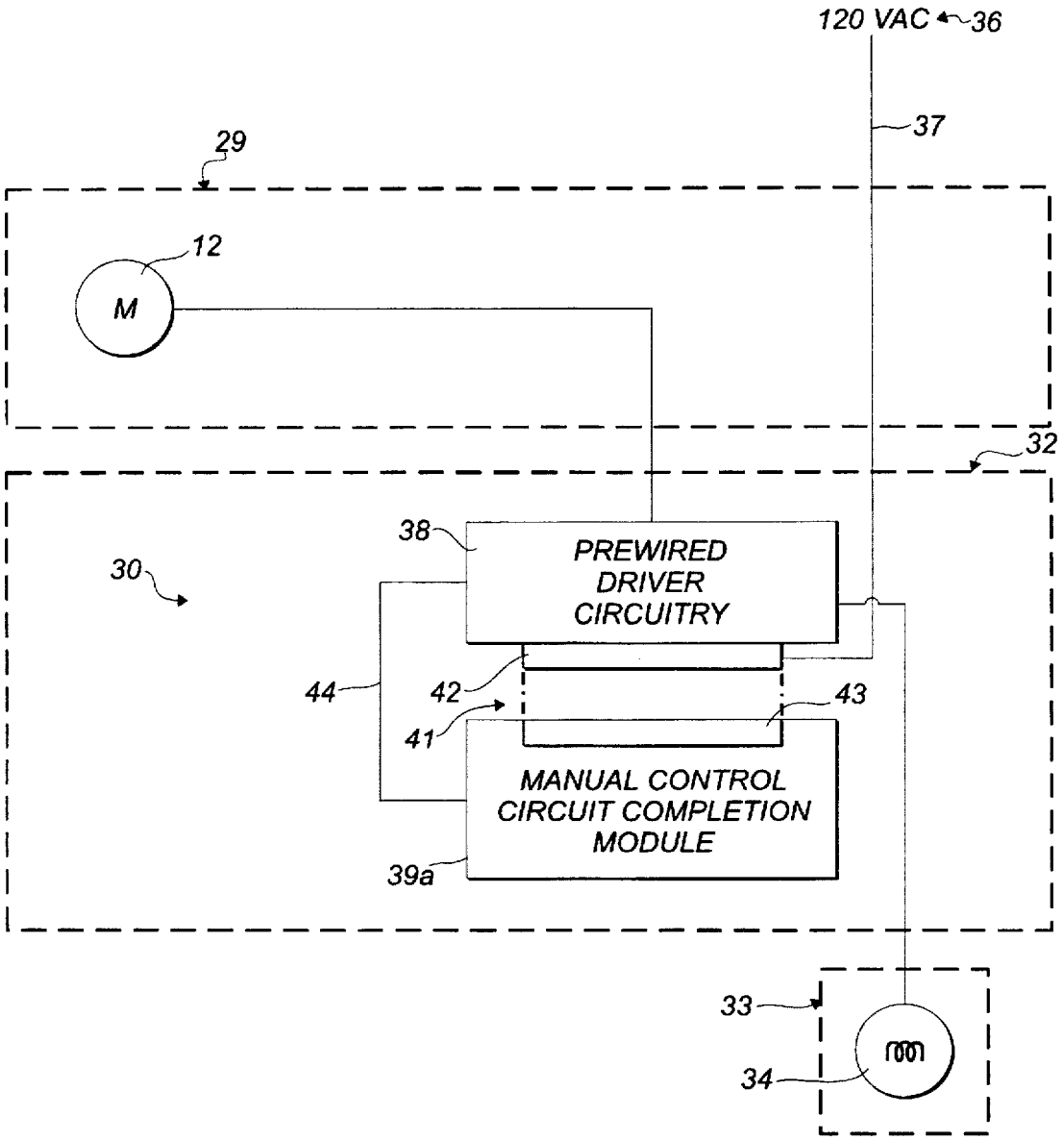
FIG. 3 is a schematic representation, partially in block diagram form, of a manually controlled driver control circuit embodying features of the present invention.

FIG. 3 depicts a schematic representation, partially in block diagram form, of the driver control circuitry 30 according to a preferred embodiment of the present invention. In this embodiment, the driver control circuitry 30 is configured to allow manual control of fan 11. Circuit completion module 39 is selectively designed as a manual control circuit completion module 39*a* which contains the necessary circuitry for completing a manually controlled motor driving circuit and light driving circuit. The switch housing 32 (shown in dashed lines) is the primary installation location for the prewired driver circuitry 38 and circuit completion module 39*a* where substantially all of the electrical connections of fan 11 are made. As generally referred to above with respect to FIG. 2, the prewired driver circuitry 38 is installed in a relatively permanently interconnected fashion in the switch housing 32 while the circuit completion module 39*a* is electrically connected thereto via connector means 41. Connector means 41 generally includes a first and second connector means. In a preferred embodiment, first connector means comprises a "multiple pin" male end connector 42 while second connector means comprises a corresponding "multiple pin" female end connector 43. Preferably, the male end connector 42 is electrically interconnected with (i.e., part of) the prewired driver circuitry 38 while the female end connector 43 is electrically interconnected with (i.e., part of) the circuitry in circuit completion module 39*a*.

The prewired driver circuitry 38 preferably includes conventionally mounted switching means and electrical components for manually controlling or actuating (at fan 11) the speed and direction of motor 12 and the illumination of light 34 in light fixture 33 (shown in dashed lines). However, as stated above, the prewired driver circuitry 38 generally does not include all of the wiring and/or components necessary to complete a total primary driver circuit such as a motor driving circuit and/or a light driving circuit. The completion of a motor driving circuit and/or a light driving circuit is accomplished by plugging the male end connector 42 of the prewired driver circuitry 38 into the female end connector 43 of the circuit completion module 39*a*.

Module 39*a* basically comprises the female end connector 43 and necessary wiring 44 for electrically communicating with the existing prewired driver circuitry 38. Module 39*a* may further include the speed control portion of the switching means for manually controlling the speed of motor 12. Unless already accomplished by a manufacturer, if a user desires to manually operate fan 11 by the switching means in switch housing 32, the user has to simply plug module 39*a* into the prewired driver circuitry 38.

Electrical power is supplied to fan 11 via terminal lines 37 which extend from A.C. supply voltage 36 downwardly through mounting plate 23, canopy 24, downrod 26, boss 27 and central shaft 16 (i.e., motor housing 29 shown in dashed lines) into switch housing 32 where they are selectively connected to male end connector 42 of connector means 41. Once female end connector 43 of module 39*a* is electrically mated with male end connector 42, electrical power is available for selective channeling through the prewired driver circuitry 38 and wiring 44 of module 39*a* to the motor 12 and/or light 34.

Figure 9:
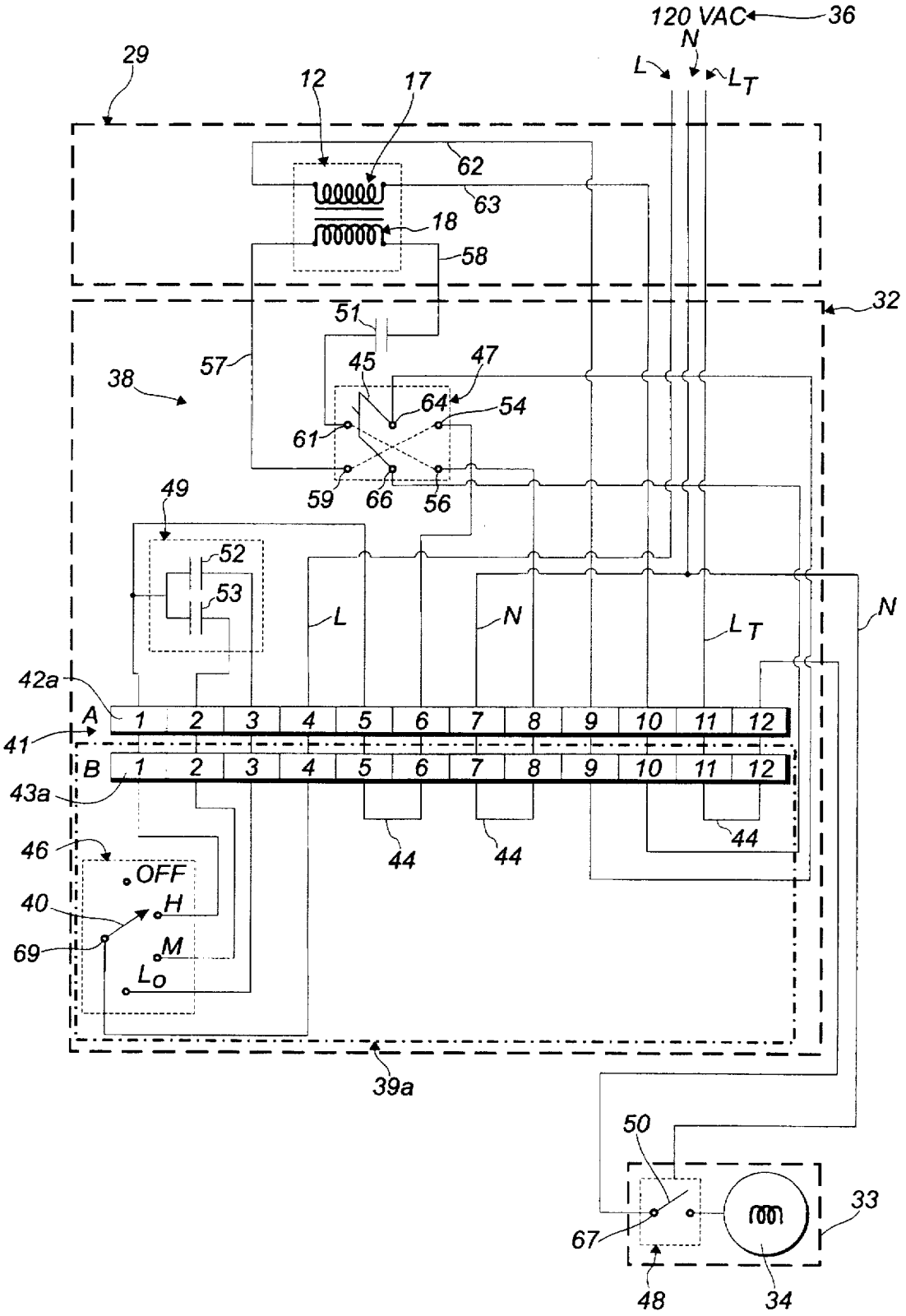
FIG. 9 is a detailed schematic representation of the driver control circuitry in FIG. 3 embodying features of the present invention.

FIG. 9 is a detailed schematic representation of the driver control circuitry 30 depicted in FIG. 3 according to one preferred embodiment of the present invention. The prewired driver circuitry 38 may include a speed control switching means 46 for manually controlling the speed of motor 12, a reverse switching means 47 for manually reversing the direction of motor 12, a light switching means 48 for manually controlling the illumination and/or intensity of light 34, a motor impedance means 49 for selectively lowering the supply voltage to the main 17 and auxiliary 18 windings of motor 12, and a phase capacitor 51 for operating motor 12. Depending upon the voltage rating of motor 12 and the design of windings 17 and 18, capacitor 51 may have a value ranging from approximately 3 to 10 μF. In the embodiment shown in FIG. 9, capacitor 51 is electrically connected in series with auxiliary winding 18.

Speed control switching means 46 preferably comprises a conventional pull-chain switch 40 for enabling a user to manually select between different motor speeds as well as to turn motor 12 off. Reverse switching means 47 preferably comprises a double-pole double-throw (DPDT) slide switch 45. Light switching means 48 preferably comprises a conventional single-pole single-throw (SPST) pull-chain switch 50 for enabling a user to turn light 34 on and off. Since standard light fixtures typically include their own light switch, light switching means 48 is shown located in light fixture 33 but is still defined as part of prewired driver circuitry 38. While the above types of switches are preferred, any suitable switch capable of performing the intended function may suffice.

Connector means 41 preferably comprises a 12-pin male end connector **42*a* and a corresponding 12-pin female end connector 43*a*. Male end connector 42*a* is also shown labeled as "A" and its shielded male conductor contacts (i.e., pins) are consecutively numbered 1–12 for clarity. Similarly, female end connector 43*a* is shown labeled as "B" and its shielded female conductor contacts (i.e., sockets) are consecutively numbered 1–12. When male end connector 42*a* is plugged into female end connector 43*a*, "A1" is in electrical communication with "B1", "A2"with "B2", "A3"with "B3", and so forth. While connectors 42*a* and 43*a*** are shown as "in-line" connectors, it should be noted that they may be constructed in any suitable size or shape so long as they perform their intended function.

The function of motor impedance means 49 may be accomplished by any standard engineering method for induction motors. Capacitors are the most commonly used form of external impedance to control induction motor speed because they generate relatively little heat when compared to other types of external impedance such as resistors and inductors. Therefore, motor impedance means 49 may comprise at least one capacitor in series with motor 12. In order to enable a user the ability to select between a sufficient number of motor speeds, such as high, medium and low speeds, motor impedance means 49 preferably comprise first 52 and second 53 speed control capacitors in series with motor 12 for selectively dropping the supply voltage to the main 17 and auxiliary 18 windings. First 52 and second 53 capacitors preferably have different values to offer different impedance to motor 12. For example, first capacitor 52 may have a value of approximately 5 μF to obtain a "low" motor speed while second capacitor 53 may have a value of approximately 10 μF to obtain a "medium" speed of motor 12. There is no capacitor in series with motor 12 to obtain a "high" speed. By selectively connecting the first 52 and second 53 speed control capacitors between speed control means 46 and windings 17 and 18, a user may selectively change the speed of motor 12.

Electrical power from A.C. supply voltage 36 is available at A4, A7 and A11 of male end connector **42*a*** via load line L, neutral line N and light load line $L_T$, respectively.

According to the embodiment illustrated in FIG. 9, in order to complete a manually controlled motor driving circuit and light driving circuit, the prewired driver circuitry 38 and the circuitry in circuit completion module **39*a*** are preferably connected in the following manner.

In the motor driving circuit, terminals 54 and 56 of slide switch 45 are connected to A6 and A8 of male end connector **42*a*, respectively. First 52 and second 53 speed control capacitors are connected to A3 and A2 of male end connector 42*a*, respectively. Central terminal 69 of pull-chain switch 40 is connected to B4 of female end connector 43*a*. H, M and $L_o$ terminals of pull-chain switch 40 are connected to B1, B2 and B3 of female end connector 43*a*, respectively. Load line L supply at terminal 54 of slide switch 45 is from A4 through B4; through pull-chain switch 40; through B1, B2 or B3 depending on the position of switch 40; through A1, A2 or A3 depending on the position of switch 40; through first 52 or second 53 speed control capacitor if the power supply is from A3 or A2, respectively; through A5; through B5; back through B6; through A6; to terminal 54. Thus, the supply voltage at terminal 54 may be selectively dropped by either the first 52 or second 53 speed control capacitor depending on the position of pull-chain switch 40. Neutral line N supply at terminal 56 of slide switch 45 is available from A7 through B7; back through B8; through A8; to terminal 56**.

Electrical communication between the auxiliary winding 18 of motor 12 and slide switch 45 is established in the following manner. Auxiliary winding leads 57 and 58 are connected to terminals 59 and 61 of slide switch 45, respectively. Phase capacitor 51 is connected in series with auxiliary winding 18 by way of auxiliary winding lead 58. Terminals 59 and 61 are connected to terminals 54 and 56, respectively. Load line L supply to auxiliary winding 18 is available from terminal 54; through terminal 59; through lead 57 to auxiliary winding 18. Neutral line N supply to auxiliary winding 18 is available from terminal 56; through terminal 61; through capacitor 51 and auxiliary winding lead 58; to auxiliary winding 18. Note that the direction of auxiliary winding 18 is not altered by changing the direction of slide switch 45.

Electrical communication between the main winding 17 of motor 12 and slide switch 45 is established in the following manner. Main winding leads 62 and 63 are connected to A9 and A10 of male end connector **42*a*, respectively. Central terminals 64 and 66 of slide switch 45 are connected to B9 and B10 of female end connector 43*a*, respectively. Depending on the position of slide switch 45, load line L supply to main winding 17 is available either from terminal 54 or terminal 59. In one position, load line L supply to main winding 17 is available from terminal 54; through terminal 64; through B9; through A9; through main winding lead 62 to main winding 17. When slide switch 45 is in the opposite position, load line L supply to main winding 17 is from terminal 59 through terminal 66; through B10; through A10; through main winding lead 63 to main winding 17. Similarly, neutral line N supply to main winding 17 is available either from terminal 56 through terminal 66; through B10; through A10; through main winding lead 63 to main winding 17 or from terminal 61 through terminal 64; through B9; through A9; through main winding lead 62 to main winding 17, depending on the position of slide switch 45. According to this particular wiring configuration, by changing the position of central terminals 64 and 66, slide switch 45 reverses the polarity of the power supply (e.g., load line L and neutral line N) to the main winding leads 62 and 63 of motor 12**. By doing so, the direction of main winding 17 reverses which reverses the direction of motor 12. Notice that the direction of only one of the windings 17 or 18 needs to be reversed to reverse the direction of motor 12.

In the light driving circuit, terminal 67 of pull-chain switch 50 is connected to A12 of male end connector 42*a*. Light load line $L_T$ supply at terminal 67 is available from A11 through B11; back through B12; through A12; to terminal 67. Neutral line N supply is connected directly to switch 50.

Figure 11:
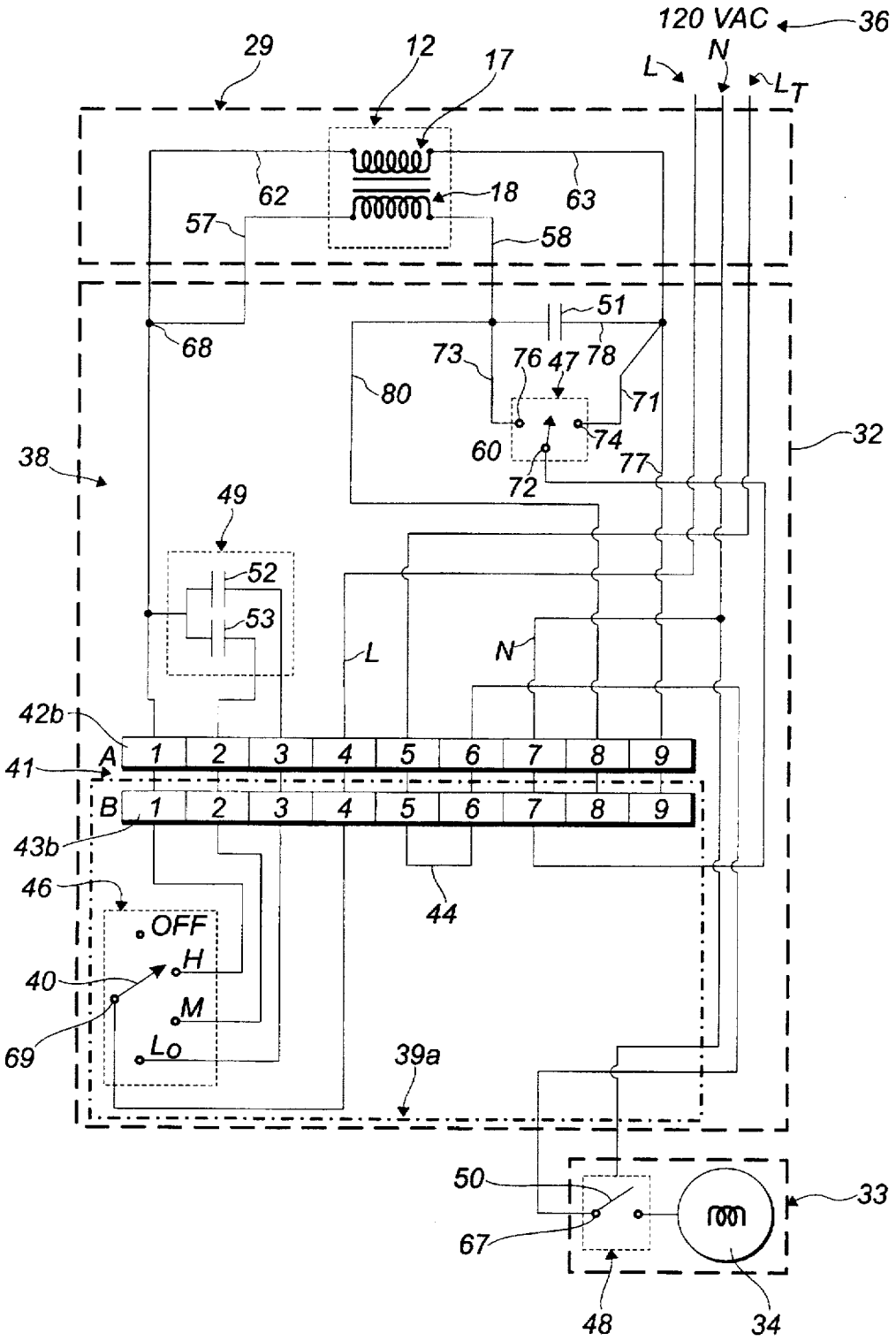
FIG. 11 is a detailed schematic representation of another version of the driver control circuitry in FIG. 3 embodying features of the present invention.

FIG. 11 also depicts a detailed schematic representation of the driver control circuitry 30 in FIG. 3 according to another embodiment of the present invention. The prewired driver circuitry 38 and manual control circuit completion module 39*a* contain substantially the same electrical elements as described in relation to FIG. 9 with the noted exceptions. Reverse switching means 47 preferably comprises a single-pole double-throw (SPDT) slide switch 60 while connector means 41 is preferably comprised of a 9-pin male end connector 42*b* and a 9-pin female end connector 43*b*. Male end connector 42*b* is also shown labeled as "A" and its shielded male conductor contacts (i.e., pins) are consecutively numbered 1–9 for clarity. Similarly, female end connector 43*b* is also shown labeled as "B" and its shielded female conductor contacts (i.e., sockets) are consecutively numbered 1–9. When male end connector 42*b* is plugged into female end connector 43*b*, "A1" is in electrical communication with "B1", "A2" with "B2", "A3" with "B3", and so forth. While connectors 42*b* and 43*b* are shown as "in-line" connectors, it should be noted that they may be constructed in any suitable size or shape so long as they perform their intended function.

Electrical power from A.C. supply voltage 36 is available at A4, A5, and A7 of male end connector 42*b* via load line L, light load line $L_T$ and neutral line N, respectively. According to the embodiment illustrated in FIG. 11, in order to complete a manually controlled motor driving circuit and light driving circuit, the prewired driver circuitry 38 and the circuitry in circuit completion module 39*a* are preferably connected in the following manner.

In the motor driving circuit, main winding lead 62 and auxiliary winding lead 57 are connected at common point 68. Load line L supply at common point 68 is available from A4 through B4; through pull-chain switch 40; through B1, B2 or B3 depending on the position of switch 40; through A1, A2 or A3 depending on the position of switch 40; through first 52 or second 53 speed control capacitor if the power supply is from A3 or A2, respectively; to common point 68. Thus, the supply voltage at common point 68 may be selectively dropped by either the first 52 or second 53 speed control capacitor before entering windings 17 and 18 depending on the position of pull-chain switch 40. Load line L supply to main winding 17 is through main winding lead 62 from common point 68. Likewise, load line L supply to auxiliary winding 18 is through auxiliary winding lead 57 from common point 68.

Center terminal 72 of slide switch 60 is connected to B7 of female end connector 43*b*. Neutral line N supply at center terminal 72 is available from A7 through B7 to terminal 72. Main winding lead 63 and auxiliary winding lead 58 are connected to terminals 74 and 76 of slide switch 60 via leads 71 and 73, respectively. Note also that main winding lead 63 and auxiliary winding lead 58 are connected to A9 and A8 of male end connector 42*b* via leads 77 and 80, respectively. However, leads 77 and 80 do not functionally contribute to this embodiment because B8 and B9 of female end connector 43*b* are open. Capacitor 51 is connected across main winding lead 63 and auxiliary winding lead 58 via lead 78. Depending on the position of slide switch 60, neutral line N supply to main winding 17 is available either from terminal 72 through terminal 74; through lead 71; through main winding lead 63; to main winding 17 or from terminal 72 through terminal 76; through lead 73; through capacitor 51 and lead 78; through main winding lead 63; to main winding 17. Similarly, neutral line N supply to auxiliary winding 18 is available either from terminal 72 through terminal 74; through lead 71; through capacitor 51 and lead 78; through auxiliary winding lead 58 to auxiliary winding 18 or from terminal 72 through terminal 76; through lead 73; through auxiliary winding lead 58 to auxiliary winding 18, depending on the position of slide switch 60. Therefore, by changing the position of slide switch 60, main winding 17 is converted into an auxiliary winding and auxiliary winding 18 is converted into a main winding which is one method for reversin the direction of motor 12.

In the light driving circuit, terminal 67 of pull-chain switch 50 is connected to A6 of male end connector 42*b*. Light load line $L_T$ supply at terminal 67 is available from A5 through B5; back through B6; through A6; to terminal 67. Neutral line N supply is connected directly to switch 50.

Figure 4:
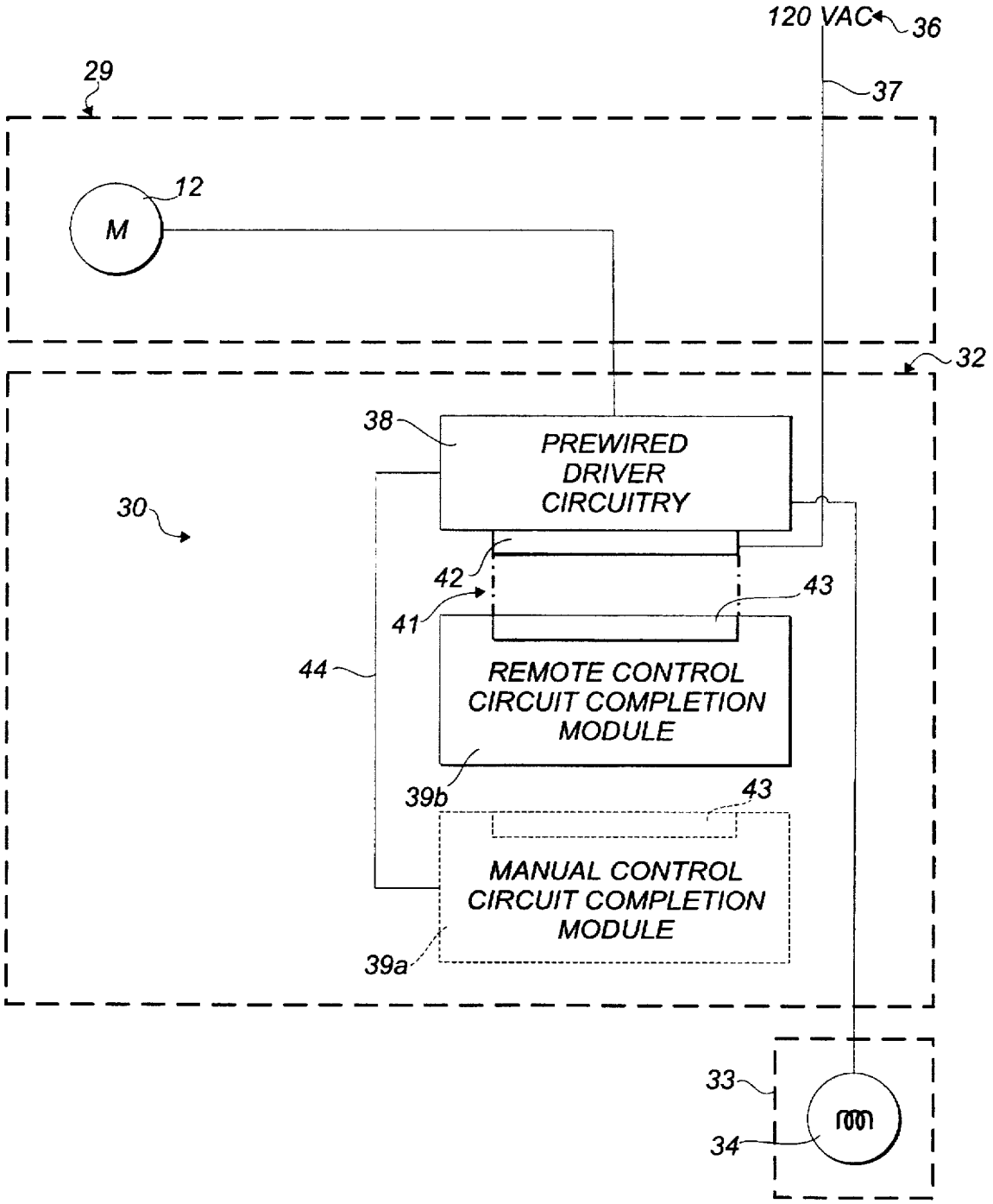
FIG. 4 is a schematic representation, partially in block diagram form, of a remotely controlled driver control circuit embodying features of the present invention.

FIG. 4 depicts a schematic representation, partially in block diagram form, of the driver control circuitry 30 according to a preferred embodiment of the present invention. According to this embodiment, the driver control circuitry 30 is selectively configured to allow a user to remotely control the operation of fan 11. Circuit completion module 39 as a remote control circuit completion module 39*b* which contains the necessary circuitry for completing a remotely controlled motor driving circuit and light driving circuit. Moreover, in this embodiment, the prewired driver circuitry 38 and connector means 41 are substantially the same as that described in reference to FIG. 3. In order to convert the manually operated fan 11 as described in reference to FIG. 3 into a remotely controlled fan 11, the user has to simply unplug the manual control module 39*a* from the prewired driver circuitry 38 and plug the remote control module 39*b* in its place (i.e., into the prewired driver circuitry 38). Since module 39*a* is wired directly to at least one electrical component (e.g., reversing switching means 47) in the prewired driver circuitry 38, module 39*a* preferably remains in the switch housing 32 once it is disconnected as shown in dashed lines in FIG. 4.

Depending on the circuitry contained in the remote control module 39*b*, module 39*b* may enable a user to remotely control the motor 12 on/off, speed and direction functions as well as the light 34 on/off and intensity functions. A fan 11 having all of the above functions remotely available is defined as a full-function remote control fan. Module 39*b* may also be intentionally designed to make remotely available only a selected number of the above functions. Such a fan 11 is defined as a partial-function remote control fan.

Figure 5:
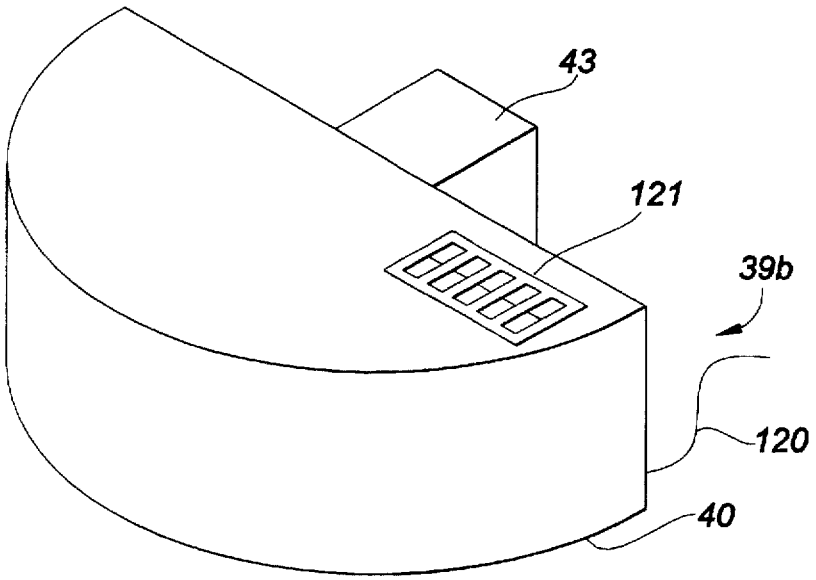
FIG. 5 is a perspective view of a modularized housing of an add-on remote control circuit completion module embodying features of the present invention.
Figure 6:
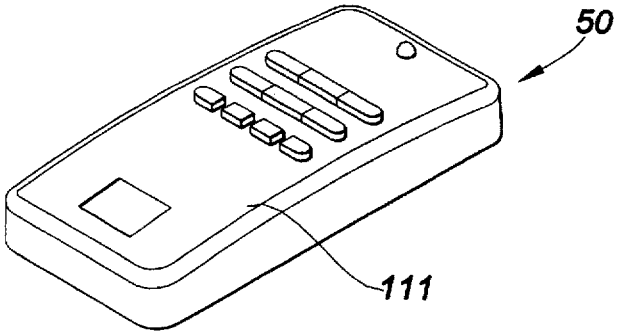
FIG. 6 is a perspective view of a transmitter unit embodying features of the present invention.

As illustrated in FIG. 5, module 39*b* includes a modularized housing 40 for containing the necessary circuitry to complete the remotely controlled motor and light driving circuits. Housing 40 may be selectively designed to be easily installed in most ceiling fan switch housings, such as switch housing 32. Moreover, as shown in FIG. 6, the present invention may include a remote transmitter unit 50 for communicating with module 39*b*. Transmitter unit 50 may be hand held or permanently mounted in a wall in which case it is wired directly to fan 11. As discussed below in relation to FIG. 14, transmitter unit 50 enables a user to send appropriate control signals to module 39*b* to remotely control the above described functions of fan 11. Unlike known add-on remote control modules, if module 39b or transmitter unit 50 become inoperable for any reason, the user may simply convert fan 11 back to manual control (until module 39b and/or transmitter unit 50 are repaired or replaced) by simply unplugging module 39b and plugging module 39a back into the prewired driver circuitry 38.

Figure 7:
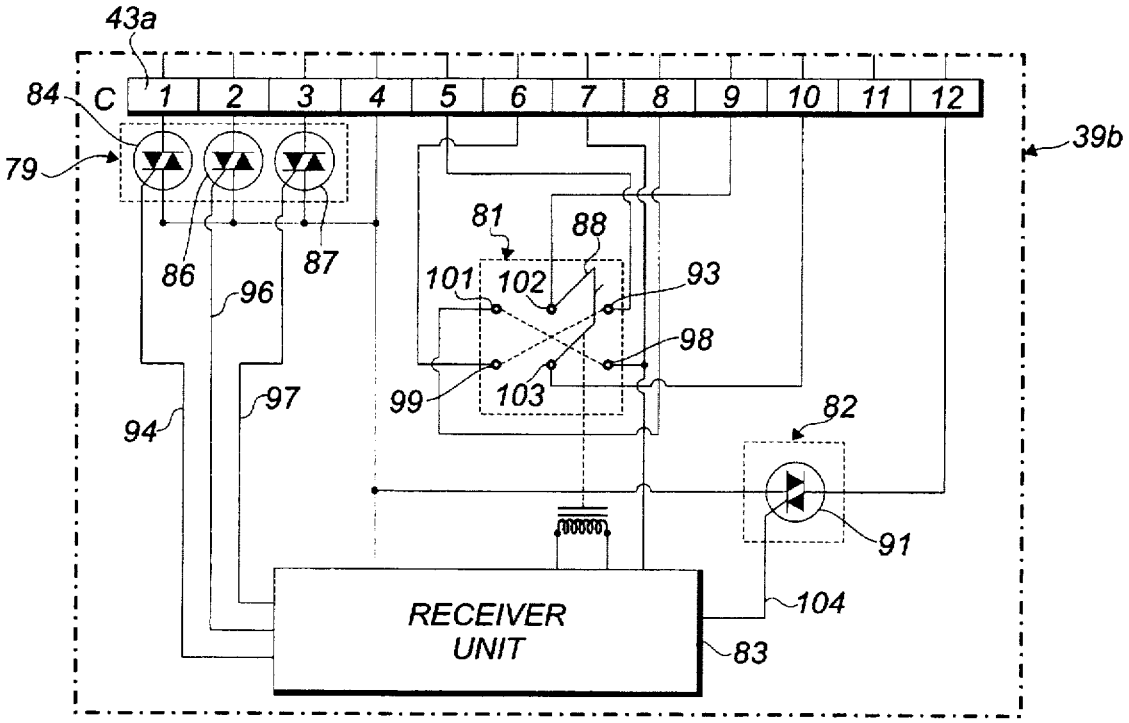
FIG. 7 is a detailed schematic representation of an add-on remote control circuit completion module embodying features of the present invention.

FIG. 7 depicts a detailed schematic representation of a remote control circuit completion module 39b according to one preferred embodiment of the present invention. Module 39b includes a speed control switching device 79 for enabling a user to remotely select between different motor 12 speeds, a reverse switching device 81 for enabling a user to remotely reverse the direction of motor 12, a light dimmer device 82 for enabling a user to remotely control the intensity of light 34, a receiver unit 83 for controlling the above devices in response to communication signals received from transmitter unit 50, and 12-pin female end connector 43a of connector means 41. Female end connector 43a is shown labeled as "C" and its shielded female conductor contacts (i.e., sockets) are consecutively numbered 1–12 for clarity. Even though receiver unit 83 may assume a variety of conventional configurations, a preferred embodiment is discussed below with reference to FIG. 13.

Unlike known add-on remote control modules, speed control switching device 79 utilizes motor impedance means 49 (shown in FIGS. 9–12), which are originally installed in switch housing 32, to remotely control the speed of motor 12. Thus, there is no need to provide a separate motor impedance means in module 39b. By employing the use of the already existing motor impedance means 49 in the prewired driver circuitry 38, module 39b has several advantages over the known add-on remote control modules. For example, by selectively designing the speed control switching device 79 in module 39b to utilize the pre-existing motor impedance means 49 in fan 11, module 39b will be small enough to readily fit in switch housing 32 which facilitates easier installation by a user in direct contrast to known add-on modules which typically must be placed in the canopy of the fan. Moreover, by not requiring a duplicate set of capacitors, module 39b may be less expensive than existing add-on modules.

Speed control switching device 79 may comprise any suitable network means, such as general purpose relays, triacs or the like, for selectively switching between the use or non-use of speed control capacitors 52 and 53. In the embodiment shown in FIG. 7, switching device 79 comprises a set of triacs 84, 86 and 87, which are selectively controlled by individual signals received from receiver unit 83. The electrical interconnection between triacs 84, 86 and 87 and the prewired driver circuitry 38 (e.g.,) capacitors 52 and 53) will be discussed below in more detail with reference to FIG. 10. Reverse switching device 81 preferably comprises a double-pole double-throw (DPDT) relay switch 88. Switch 88 includes and is controlled by relay 89 which is selectively controlled by a signal from receiver unit 83. As discussed below in greater detail with reference to FIG. 10, electrical communication between windings 17 and 18 of motor 12 and relay switch 88 is established once module 39b is plugged into the prewired driver circuitry 38. Light dimmer device 82 preferably comprises triac 91 which is selectively controlled by a signal from receiver unit 83.

Figure 8:
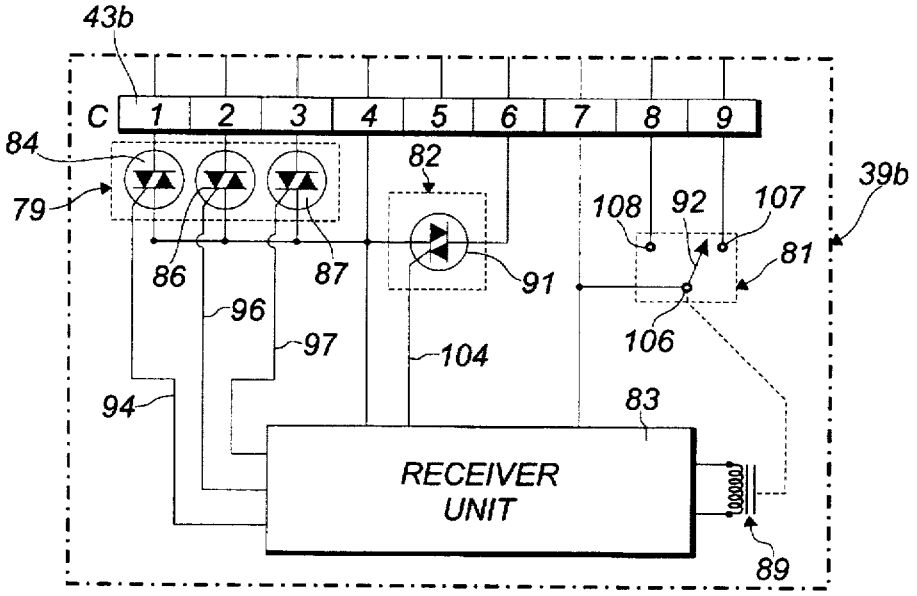
FIG. 8 is a detailed schematic representation of another version of an add-on remote control circuit completion module embodying features of the present invention.

FIG. 8 also depicts a detailed schematic representation of a remote control circuit completion module 39b according to another embodiment of the present invention. Module 39b, as illustrated in FIG. 8, contains substantially the same electrical circuitry as described in relation to FIG. 7 except for the following. Reverse switching device 81 preferably comprises a single-pole double-throw (SPDT) relay switch 92 and connector means 41 is preferably comprised of 9-pin female end connector 43b. Female end connector 43b is also shown labeled as "C" and its shielded female conductor contacts (i.e., sockets) are consecutively numbered 1–9 for clarity. Switch 92 includes and is controlled by relay 90 which is selectively controlled by a signal from receiver unit 83. The electrical communication between windings 17 and 18 of motor 12 and reversing switch 92, once module 39b is plugged into the prewired driver circuitry 38, is discussed more fully below with reference to FIG. 12.

Figure 10:
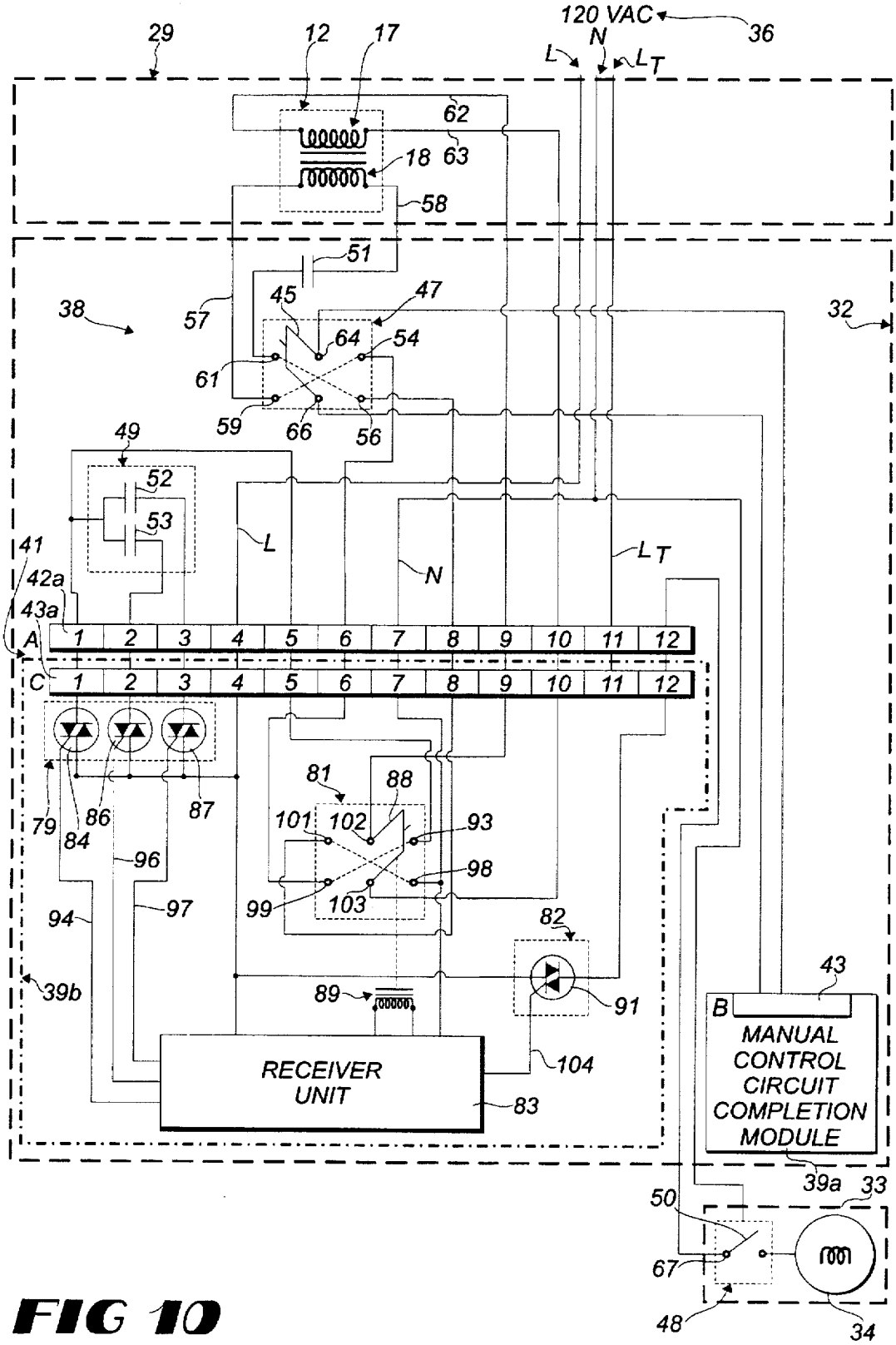
FIG. 10 is a detailed schematic representation of the driver control circuitry in FIG. 4 which incorporates the add-on remote control circuit completion module of FIG. 7 embodying features of the present invention.

FIG. 10 is a detailed schematic representation of the driver control circuitry 30 depicted in FIG. 4 which incorporates the add-on remote control circuit completion module 39b of FIG. 7 according to one preferred embodiment of the present invention. The prewired driver circuitry 38 is substantially the same as that described in reference to FIG. 9. In this particular embodiment, since manual control circuit completion module 39a is disconnected from the prewired driver circuitry 38, speed control switching means 46 (e.g., switch 40) and reverse switching means 47 (e.g., switch 45) do not functionally contribute to the operation of fan 11. That is, changing the positions of switching means 46 and 47 will not alter the speed nor direction of motor 12.

In order to complete a full-function remotely controlled motor driving circuit and light driving circuit, the prewired driver circuitry 38 and the circuitry in circuit completion module 39b are preferably connected in the following manner. In the motor driving circuit, receiver unit 83 is connected to C4 and C7 of female end connector 43a. Load line L supply at receiver unit 83 is available from A4 through C4 to receiver unit 83. Neutral line N supply at receiver unit 83 is available from A7 through C7 to receiver unit 83. Terminals 93 and 98 of relay switch 88 are connected to C5 and C7, respectively. Load line L supply at terminal 93 is available from A4 through C4; through speed control switching device 79; through C1, C2 or C3 depending on which triac 84, 86 or 87 is triggered by receiver unit 83; through A1, A2 or A3 depending on which triac 84, 86 or 87 is triggered; through motor impedance means 49 if triacs 86 or 87 are triggered; back through A5; through C5; to terminal 93. Thus, the supply voltage at terminal 93 of relay switch 88 may be selectively dropped by either the first 52 or second 53 speed control capacitor if either triac 87 or 86 is respectively, triggered by receiver unit 83. Receiver unit 83 may selectively trigger triacs 84, 86 or 87 by transmitting respective gate or trigger signals through gates 94, 96 or 97. Note that if triac 84 is fired by receiver unit 83, terminal 93 will receive full power. If none of the triacs 84, 86 or 87 are fired, no power is supplied to the motor 12 (i.e., motor 12 is off). Neutral line N supply at terminal 98 of relay switch 88 is available from A7 through C7 to terminal 98.

Electrical communication between the auxiliary winding 18 of motor 12 and relay switch 88 is established in the following manner. Auxiliary winding leads 57 and 58 are connected to terminals 59 and 61 of slide switch 45, respectively. Terminals 59 and 61 are connected to terminals 54 and 56 of slide switch 45, respectively. Terminals 54 and 56 are connected to A6 and A8 of male end connector 42a, respectively. Terminals 99 and 101 of relay switch 88 are connected to C6 and C8 of female end connector 43a and to terminals 93 and 98, respectively. Load line L supply to auxiliary winding 18 is available from terminal 93; through terminal 99; through C6; through A6; through terminal 54 of slide switch 45; through terminal 59 of slide switch 45; through auxiliary winding lead 57; to auxiliary winding 18.

Neutral line N supply to auxiliary winding 18 is available from terminal 98; through terminal 101; through C8; through A8; through terminal 56 of slide switch 45; through terminal 61 of slide switch 45; through capacitor 51 and auxiliary winding lead 58; to auxiliary winding 18.

Electrical communication between the main winding 17 of motor 12 and relay switch 88 is established in the following manner. Main winding leads 62 and 63 are connected to A9 and A10 of male end connector **42*a*, respectively. Central terminals 102 and 103 of relay switch 88 are connected to C9 and C10 of female end connector 43*a*, respectively. Depending on the position of relay switch 88, load line L supply to main winding 17 is available either from terminal 93 through terminal 102; through C9; through A9; through main winding lead 62; to main winding 17 or from terminal 99 through terminal 103; through C10; through A10; through main winding lead 63; to main winding 17. Similarly, neutral line N supply to main winding 17 is available either from terminal 98 through terminal 103; through C10; through A10; through main winding lead 63; to main winding 17 or from terminal 101 through terminal 102; through C9; through A9; through main winding lead 62; to main winding 17, depending on the position of relay switch 88. Therefore, according to this particular winding configuration, by changing the position of central terminals 102 and 103, relay switch 88 reverses the polarity of the power supply (e.g., load line L and neutral line N) to the main winding leads 62 and 63 of motor 12. By doing so, the direction of main winding 17 reverses which reverses the direction of motor 12. Notice again that the direction of only one of the windings 17 and 18 need to be reversed to reverse the direction of motor 12**.

In order to drive light 34, it is not necessary to utilize power from light load line $L_T$, therefore C11 of female end connector **43*a* is left open. Electrical power is supplied to light fixture 33 via load line L. Terminal 67 of pull-chain switch 50 is connected to A12 of male end connector 42*a*. Load line L supply at terminal 67 is available from A4 through C4; through light dimmer device 82; through C12; through A12 to terminal 67. Neutral line N supply is connected directly to light switching means 48. In order to remotely control the on/off function and intensity of light 34 through triac 91, pull-chain switch 50 must always be in the "on" position. Receiver unit 83 may selectively trigger triac 91 to fire on either or both of the half-cycles of the load line L input supply (i.e., to control light 34 intensity) by transmitting a corresponding gate or trigger signal through gate 104. Note that light 34 may be manually turned on and off by pull-chain switch 50 if triac 91** is conducting.

Figure 12:
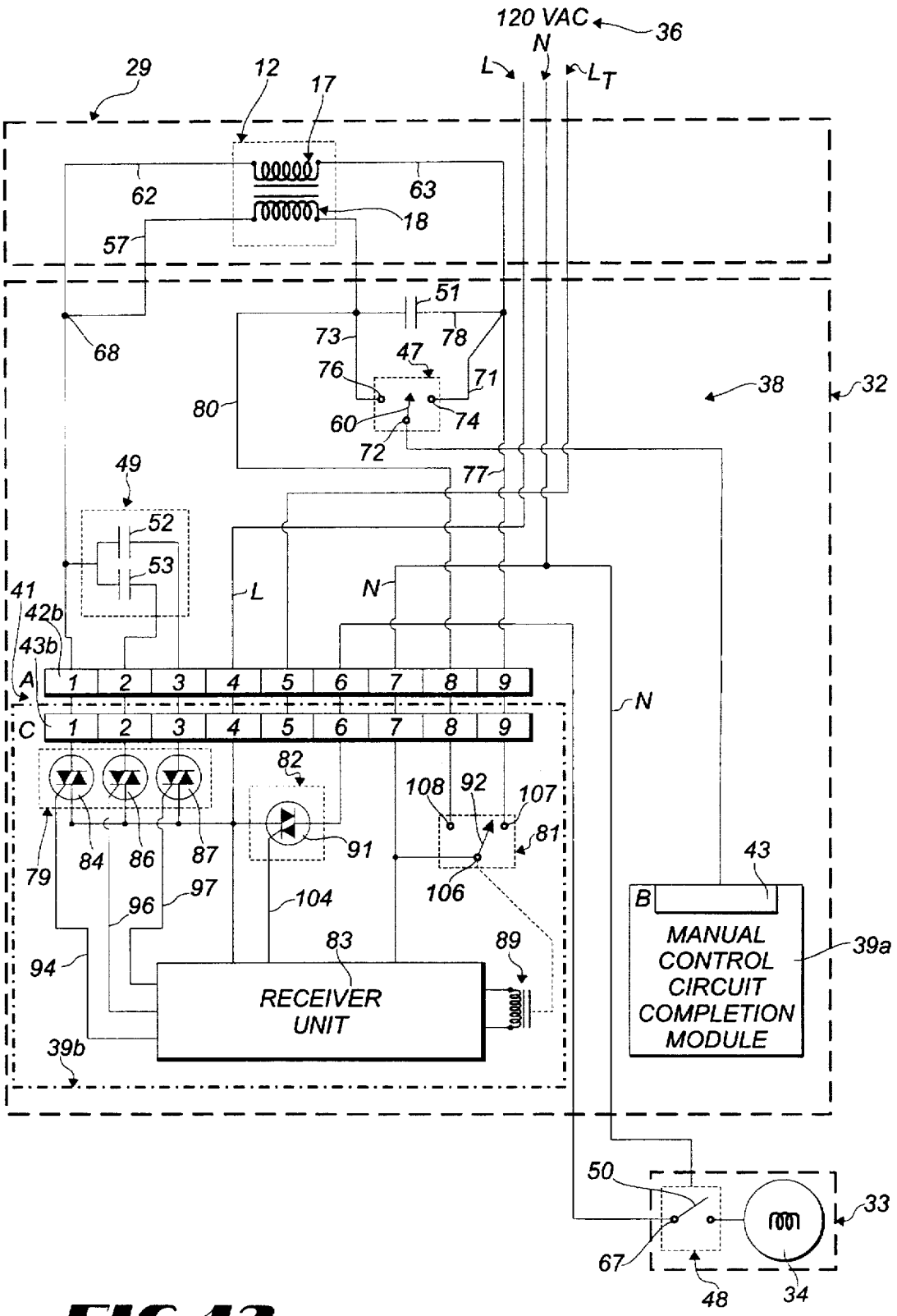
FIG. 12 is a detailed schematic representation of another version of the driver control circuitry in FIG. 4 which incorporates the add-on remote control circuit completion module of FIG. 8 embodying features of the present invention.

FIG. 12 depicts a detailed schematic representation of the driver control circuitry 30 in FIG. 4 which incorporates the add-on remote control circuit completion module **39*b* of FIG. 8 according to another embodiment of the present invention. The prewired driver circuitry 38 is substantially the same as that described in reference to FIG. 11. As indicated above with reference to FIG. 10, since module 39*a* is disconnected form the prewired driver circuitry 38, speed control switching means 46 and reverse switching means 47 do not functionally contribute to the operation of fan 11, therefore changing the positions of switches 40 and 60 will not alter the speed nor direction of motor 12. According to the embodiment illustrated in FIG. 12, in order to complete a full-function remotely controlled motor driving circuit and light driving circuit, the prewired driver circuitry 38 and the circuitry in circuit completion module 39*b*** are preferably connected in the following manner.

In the motor driving circuit, load line L supply at receiver unit 83 is from A4 through C4 to receiver unit 83. Neutral line N supply at receiver unit 83 is from A7 through C7 to receiver unit 83. Load line L supply at common point 68 of windings 17 and 18 is from A4 through C4; through speed control switching device 79; through C1, C2 or C3 depending on which triac 84, 86 or 87 is triggered by receiver unit 83; through A1, A2 or A3 depending on which triac 84, 86 or 87 is triggered; through motor impedance means 49 if triacs 86 or 87 are triggered; to common point 68. Thus, the supply voltage at common point 68 may be selectively dropped by either the first 52 or second 53 speed control capacitor before entering windings 17 and 18 depending on which triac 86 or 87 is fired by receiver unit 83. Load line L supply to main winding 17 is through main winding lead 62 from common point 68 while load line L supply to auxiliary winding 18 is through auxiliary winding lead 57 from common point 68.

Center terminal 106 of relay switch 92 is connected to C7 of female end connector **43*b*. Terminals 107 and 108 are connected to C9 and C8, respectively. Neutral line N supply at center terminal 106 is available from A7 through C7 to terminal 106. Main winding lead 63 and auxiliary winding lead 58 are connected to A9 and A8 of male end connector 42*b* via leads 77 and 80, respectively. Capacitor 51 is connected across main winding lead 63 and auxiliary winding lead 58 via lead 78. Depending on the position of relay switch 92, neutral line N supply to main winding 17 is available either from terminal 106 through terminal 107; through C9; through A9; through lead 77; through main winding lead 63 to main winding 17 or from terminal 106 through terminal 108; through C8; through A8; through lead 80; through capacitor 51 and lead 78; through main winding lead 63 to main winding 17. Similarly, neutral line N supply to auxiliary winding 18 is available either from terminal 106 through terminal 107; through C9; through A9; through lead 77; through capacitor 51 and lead 78; through auxiliary winding lead 58 to auxiliary winding 18 or from terminal 106 through terminal 108; through C8; through A8; through lead 80; through auxiliary winding lead 58 to auxiliary winding 18, depending on the position of relay switch 92. Therefore, by changing the position of relay switch 92, main winding 17 is converted into an auxiliary winding and auxiliary winding 18 is converted into a main winding which is one method for reversing the direction of motor 12**.

In order to drive light 34, it is not necessary to utilize power from light load line $L_T$, therefore C5 of female end connector **43*b* is left open. Electrical power is supplied to light fixture 33 via load line L. Terminal 67 of pull-chain switch 50 is connected to A6 of male end connector 42*b*. Load line L supply at terminal 67 is available from A4 through C4; through light dimmer device 82; through C6; through A6 to terminal 67. Neutral line N supply is connected directly to switch 50. In order to remotely control the on/off function and intensity of light 34 through triac 91, pull-chain switch 50 must always be in the "on" position. Receiver unit 83 may selectively trigger triac 91 to fire on either or both of the half-cycles of the load line L input supply (i.e., to control light 34 intensity) by transmitting a corresponding gate or trigger signal through gate 104. Note that light 34 may be manually turned on and off by pull-chain switch 50 if triac 91** is conducting.

Figure 14:
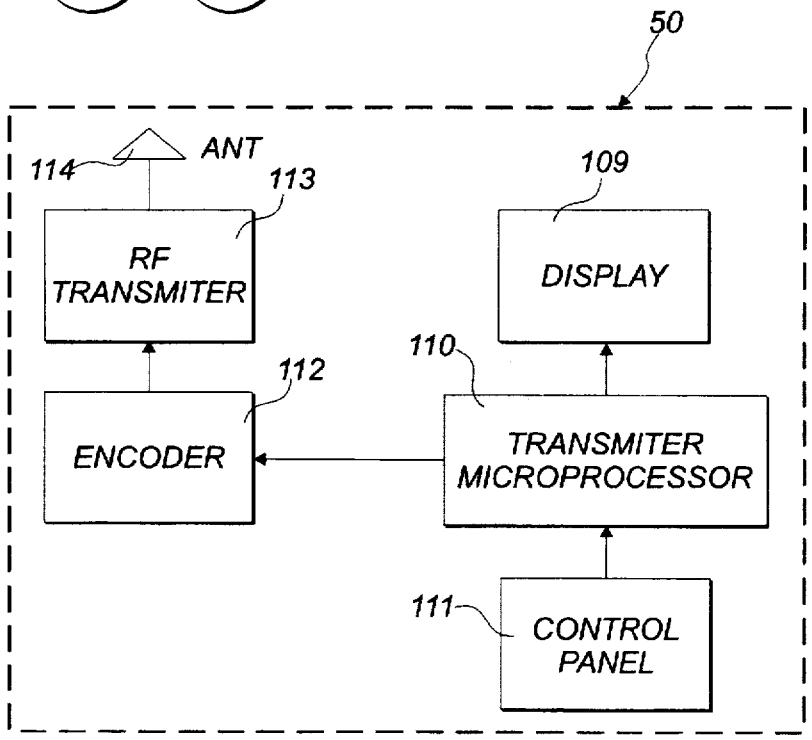
FIG. 14 is a schematic representation, partially in block diagram form, of a transmitter unit embodying features of the present invention.

FIGS. 6 and 14 depict a perspective view and a schematic representation, respectively, of a transmitter unit 50 according to one preferred embodiment of the present invention. The transmitter unit 50 comprises an optional display 109 (not shown in FIG. 6), transmitter microprocessor 110, control panel 111, encoder 112, RF transmitter 113 and antenna 114. Transmitter microprocessor 110 receives information supplied by control panel 111, which is described in more detail below, and controls the operation of display 109 and RF transmitter 113 via encoder 112. RF transmitter 113 sends coded digital RF signals on a high frequency carrier. RF transmitter 113 may be a conventional RF transmitter design having an oscillator for generating high frequency carrier waves. These carrier waves are preferably in the range of about 300 MHz to about 310 MHz. Information to be transmitted from transmitter microprocessor 110 is supplied to encoder 112. The signal generated from encoder 112 is superimposed over the carrier wave and transmitted via antenna 114.

Display 109 may employ any of numerous display technologies, such as LED, LCD, CRT, or the like. Display 109 may have a fan speed indicator, light on/off indicator, light level indicators, low battery indicator, room temperature indicator as well as other indicators. Control panel 111 may include any of numerous devices of inputting control information, such as buttons, a key-board, a knob, or the like. Transmitter microprocessor 110 is preferably a single chip microcomputer such as an OKI MSM64164 which has 4096 bytes of read-only memory (ROM) for storing software and 256×4 bits of random-access memory (RAM). A DC power supply (not shown) supplies all of the power for the transmitter microprocessor via a central processing unit (CPU) (not shown). The CPU controls the operation of the input and output of information via control panel 111. The CPU also provides an address for transmission by a transmit data controller. The address is supplied by an address switch which may comprise a set of dip switches which allow a user to select a combination of switches to generate different combinations of encoded signals. Each combination of switches provides a different address to prevent interference from similar units in the vicinity. An I/O device provides an encoded digital signal to the CPU corresponding to the switches at the address switch.

Figure 13:
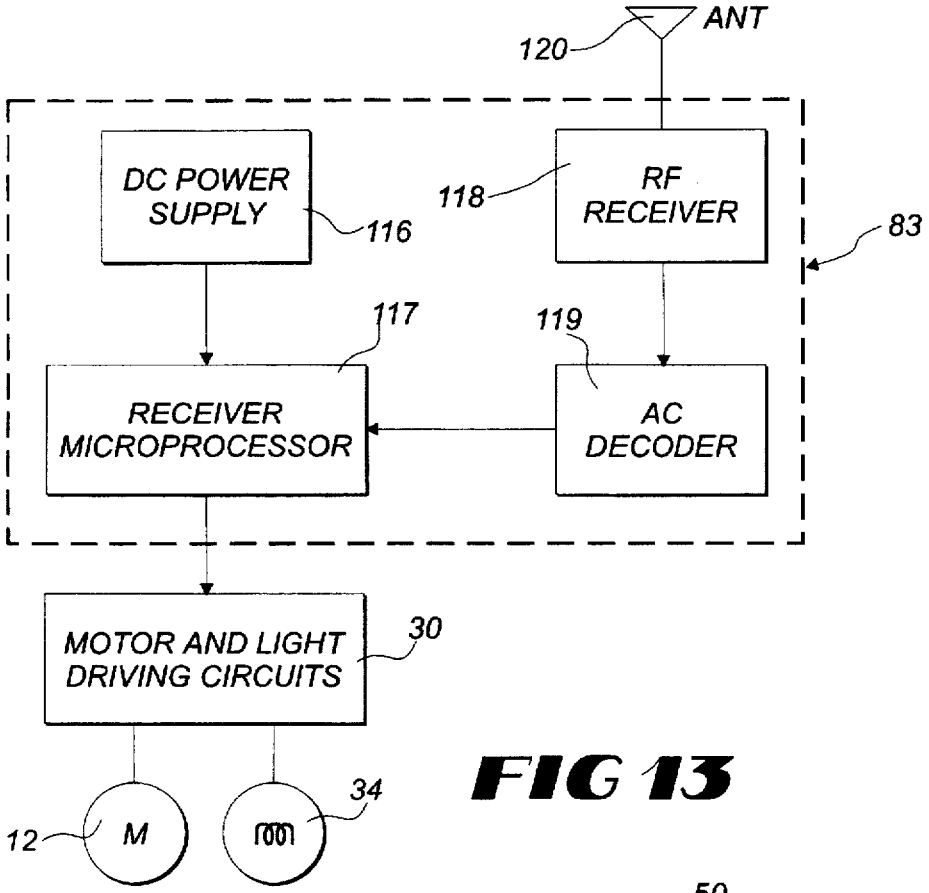
FIG. 13 is a schematic representation, partially in block diagram form, of a receiver unit embodying features of the present invention.

FIG. 13 depicts a schematic representation of a receiver unit 83 according to one preferred embodiment of the present invention. Receiver unit 83 comprises a DC power supply unit 116, receiver microprocessor 117, RF receiver 118, a AC decoder 119. Remote control receiver unit 83 connects to an antenna 120 and the motor and light driving circuits 30, which control motor 12 and light 34. DC power supply unit 116 converts 120 VAC power supplied from A.C. supply voltage 36 to a regulated DC power supply for receiver microprocessor 117. RF receiver 118 is a typical RF regenerative type receiver which receives a RF signal via antenna 120 and passes the received RF signal in the form of an AC signal to AC decoder 119. AC decoder 119 decodes the AC signal into digital information for transmission to receiver microprocessor 117. Receiver microprocessor 117 controls the operation of the motor and light driving circuits 30.

Receiver microprocessor 117 comprises a system clock generator, a CPU, an input/output (I/O) device and an output controller. Receiver microprocessor 117 may be a single chip microcomputer, such as a Hitachi HD404201 has 1024 bytes of ROM and 64×4 bits of RAM for data storage. The CPU receives power from DC power supply 116. The system clock generator provides the clock rate for the entire receiver microprocessor 117 based upon a system clock generating element, such as a crystal and provides a periodic signal for clocking in data from the I/O device. The I/O device receives data from AC decoder 119. Further, an address switch sets an address for receiving transmission from RF transmitter 113. The address switch may compare, for example, a plurality of dip switches 121 (shown in FIG.5) which may be selected in different combinations to generate different encoded addresses. The address switch of receiver microprocessor 117 should be set to the same encoded value as is set in the address switch of transmitter microprocessor 110. By having a unique address for each RF receiver 118, multiple receivers 118 may be controlled by a single RF transmitter 113, or multiple RF transmitters 113 may control a single RF receiver 118. Alternatively, if desired, only one RF receiver 118 will be controlled by one RF transmitter 113, even if multiple fans 11 are located within a single space.

Although the invention is described with respect to the preferred embodiments, it is expected that various modifications may be made thereto without departing from the spirit and scope of the invention. Therefore, the scope of the invention is to be determined by reference to the claims which follow.

What is claimed is:

1. An add-on remote control module for converting a non-remote controlled ceiling fan into a remote controlled ceiling fan, said non-remote controlled ceiling fan having a motor and a portion of its driver control circuitry prewired in a switch housing, said prewired portion including motor impedance means, an electrical connector and wiring means for electrically interconnecting said motor and said motor impedance means to an A.C. power source, said wiring means terminating in said electrical connector, said add-on remote control module comprising:

(a) a speed control switching device for enabling a user to remotely select between different motor speeds, said speed control switching device utilizing said motor impedance means in said prewired portion;

(b) a receiver unit, electrically connected to said speed control switching device, for controlling said speed control switching device; and (c) connector means for electrically interconnecting said add-on remote control module to said electrical connector in said prewired portion of said driver control circuitry, said electrical interconnection converting said non-remote controlled ceiling fan into said remote controlled ceiling fan.

2. An add-on remote control module as defined in claim 1, wherein said module is installed in said switch housing of said non-remote controlled ceiling fan.

3. An add-on remote control module as defined in claim 1, wherein said non-remote controlled ceiling fan further includes a light electrically connected to said A.C. power source.

4. An add-on remote control module as defined in claim 3, further comprising a light dimmer device, electrically connected to said connector means and said receiver unit, for enabling a user to remotely control the illumination and intensity of said light.

5. An add-on remote control module as defined in claim 1, further comprising a reverse switching device, electrically connected to said connector means and said receiver unit, for enabling a user to remotely reverse the direction of said motor.

6. A driver control circuit assembly for controlling the operation of a ceiling fan having a motor, a switch housing and a light fixture with at least one location for operatively receiving a light, said ceiling fan receiving A.C. supply voltage from an A.C. power source, said driver control circuit assembly comprising:

(a) a prewired portion partially forming said driver control circuit assembly, including:

(i) manually actuable switching means for controlling the operation of said motor and the illumination of said light;

(ii) motor impedance means for allowing selective lowering of said A.C. supply voltage to said motor;

(iii) first connector means;

(iv) wiring means for selectively interconnecting said manually actuable switching means and said motor impedance means to said motor, said light and said A.C. power source, said wiring means terminating in said first connector means; and (b) an interchangeble plug-in driver circuit completion module containing selectively designed circuitry for completing at least one driver control circuit in said driver control circuit assembly, said selectively designed circuitry including second connector means adapted for ready interconnection and disconnection from said first connector means, said interconnection establishing electrical communication between said circuitry in said module and said prewired portion to complete said at least one driver control circuit.

7. A driver control circuit assembly as defined in claim 6, wherein said at least one driver control circuit comprises a manually controlled driver control circuit.

8. A driver control circuit assembly as defined in claim 6, wherein said at least one driver control circuit comprises a remotely controlled driver control circuit.

9. A driver control circuit assembly as defined in claim 7, wherein said at least one driver control circuit comprises a manually controlled motor driving circuit.

10. A driver control circuit assembly as defined in claim 7, wherein said at least one driver control circuit comprises manually controlled motor and light driving circuits.

11. A driver control circuit assembly as defined in claim 8, wherein said at least one driver control circuit comprises a remotely controlled motor driving circuit.

12. A driver control circuit assembly as defined in claim 8, wherein said at least one driver control circuit comprises remotely controlled motor and light driving circuits.

13. A ceiling fan having selectively connectable electrical circuitry for forming at least one driver control circuit, said ceiling fan comprising:

(a) a motor;

(b) a driver control circuit assembly electrically connected to said motor for controlling the operation of said motor, said driver control circuit assembly including:

(i) a prewired portion having first connector means; and (ii) an interchangeable plug-in driver circuit completion module containing selectively designed circuitry for completing at least one driver control circuit in said driver control circuit assembly, said selectively designed circuitry including second connector means adapted for ready interconnection and disconnection from said first connector means, said interconnection establishing electrical communication between said circuitry in said module and said prewired portion to complete said at least one driver control circuit.

* * * * *